United States Patent [19]

Van Dort

[11] 3,945,186

[45] Mar. 23, 1976

[54] METHOD OF MANUFACTURING TWISTLESS YARN AND THE PRODUCT THEREOF

[75] Inventor: Jacobus Maurits Van Dort, Almelo, Netherlands

[73] Assignee: Hollandse Signaalapparaten B.V., Hengelo, Netherlands

[22] Filed: Feb. 15, 1974

[21] Appl. No.: 442,850

[30] Foreign Application Priority Data

Mar. 1, 1973 Netherlands ..... 7302859

[52] U.S. Cl. ..... 57/153; 28/75 R; 57/140 BY; 57/164; 156/148; 156/166; 428/375; 428/392

[51] Int. Cl.[2] ..... D02G 3/40; D02G 3/04

[58] Field of Search ..... 57/35, 156, 157 R, 164, 57/140 BY, 144, 153, 160, 139, 140 R; 28/75 R, 76 R, 73; 156/148, 166, 167, 180; 428/357, 360, 361, 375, 378, 392–396

[56] References Cited

UNITED STATES PATENTS

| | | | |
|---|---|---|---|
| 3,447,310 | 6/1969 | Bok et al. | 57/164 |
| 3,490,219 | 1/1970 | Ozawa et al. | 57/140 R |
| 3,512,232 | 5/1970 | Bolinger | 57/168 X |
| 3,716,981 | 2/1973 | Bok | 57/139 |
| 3,745,757 | 7/1973 | Selwood | 57/157 R |
| 3,877,214 | 4/1975 | Van der Werf | 57/164 |

*Primary Examiner*—John Petrakes
*Attorney, Agent, or Firm*—Frank R. Trifari; David R. Treacy

[57] ABSTRACT

In the manufacture of twistless yarn a potentially adhesive continuous filament yarn is added to an assembly of staple fibres. The fibre mixture so obtained is supplied with a solvent which, brings the potentially adhesive filament yarn into a plastic state and, enables wet drafting of the staple fibre component. After the drafting process the staple fibres are bonded.

7 Claims, 2 Drawing Figures

METHOD OF MANUFACTURING TWISTLESS YARN AND THE PRODUCT THEREOF

Figure 1:
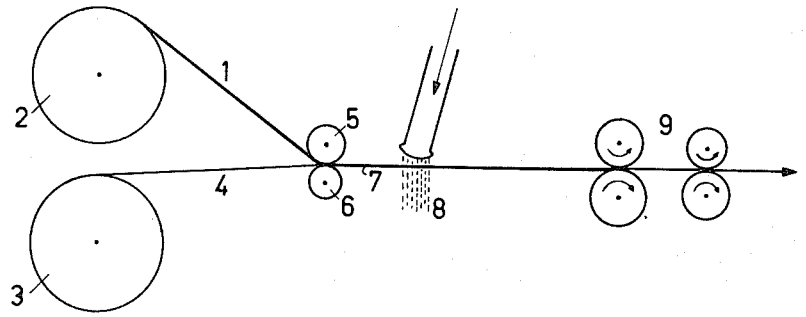

The present invention relates to a method of manufacturing twistless yarn or yarn with a relatively low twist (hereinafter referred to simply as twistless yarn) from an assembly of staple fibres, and also to the yarn obtained through the application of this method. The process to which these fibres are subjected includes at least adding a potentially adhesive fibre component to form a mixed fibre ribbon, to enable bonding of the yarn to be produced, high-speed wet drafting of the mixed fibre ribbon to a thinner fibre ribbon, and bonding this thinner ribbon.

Such a method is known in essence and is described in detail in the co-pending U.S. patent applications Ser. No. 270,152 filed July 10, 1972, now U.S. Pat. No. 3,877,214, and 404,342 filed Oct. 9, 1973. In this method the potentially adhesive fibre component consists of staple fibre material.

The object of the invention is to provide a method of manufacturing yarn in which the use of such staple fibre material for bonding of the yarn is eliminated. It is therefore possible to use an inactive adhesive material which is subjected to an activating treatment in a later phase of the production process of twistless yarn as described in U.S. Pat. No. 3,447,310. This possibility has, however, many disadvantages, such as an uncontrolled distribution of the adhesive, large losses of adhesive material, the use of a complicated adhesive supply and removal system, etc.; moreover, it implies a step backward in respect of the use of potentially adhesive fibre components.

According to the present invention, the potentially adhesive fibre component is formed by a continuous filament yarn, which is activated to assume at least a plastic state through a solvent used also for the wet drafting. As a result of such activation the staple fibre component of the fibre ribbon can be drafted while the filamentary potentially adhesive component, being in a plastic state, is capable of being extended.

Upon preliminary consideration, it may appear necessary to add the solvent during the process phase following the phase in which the mixed fibre ribbon is obtained. This solvent has thus to perform two functions: first, to bring the continuous component in the mixed fibre ribbon at least into a plastic state; and second, to wet the staple fibre component in the mixed fibre ribbon for the purpose of drafting. However, the solvent may also be added to the staple fibres during a process phase preceding that in which the mixed fibre ribbon is obtained. In this case the continuous filament softens through the contact with the wet staple fibres. The first-mentioned method of adding the solvent is, however, preferred.

The continuous filament yarn can be added to the assembly of staple fibres in different process phases; for example:

a. direct to a sliver drawn from the assembly of staple fibres. This is possible when using a card sliver; the mixed fibre ribbon is obtained by adding this sliver and the continuous filament yarn during the feed-through between rollers.

b. to a drafted sliver drawn from the assembly of staple fibres. The mixed fibre ribbon is obtained by adding the continuous filament yarn to the sliver at the final drafting rollers, used for the drafting of the sliver.

c. to a roving obtained through drafting and twisting of a sliver drawn from the assembly of staple fibres. The mixed fibre ribbon is obtained by adding the continuous filament yarn to the roving during a feed-through between rollers.

Before the present invention, mixing of continuous filament yarn with staple fibres was of no use in the aforementioned process phases, as no yarn could be produced from a mixed fibre ribbon thus obtained; the presence of continuous filament yarn rendered drafting of the mixed fibre ribbon impossible. It is found that this obstacle can be removed by employing a continuous filament yarn which can provide for the bonding of the yarn and which can be brought into a plastic state prior to the drafting of the mixed fibre ribbon, such that the drafting of the mixed fibre ribbon actually amounts to the drafting of the staple fibre component of the mixed fibre ribbon. The continuous filament yarn can be brought into this plastic state for example by the supply of hot water if the filament yarn consists of continuous unstabilized polyvinyl alcohol or alginate fibres, or by the supply of a heated mixture of water and suitable organic solvents (such as acetone, formic acid, acetic acid) if the filament yarn consists of di- or tri-acetate fibres. The way in which the bonding of the yarn itself is performed is described, for example, in the co-pending U.S. application Ser. No. 404,342 and therefore needs no further explanation.

The mixture of continuous filament yarn with a drafted roving is previously known. Such mixing occurs during "core spinning". In this process the continuous filament yarn (core) is added to the staple fibre material at the final drafting rollers used for drafting the roving or the sliver (if the phase in which the roving is produced is skipped). This method is applied to the production of twisted yarn and is executed on a ring spinning machine, where the staple fibre material is wrapped around the filament yarn. Hence, this method cannot be used for the production of twistless yarn.

Figure 2:
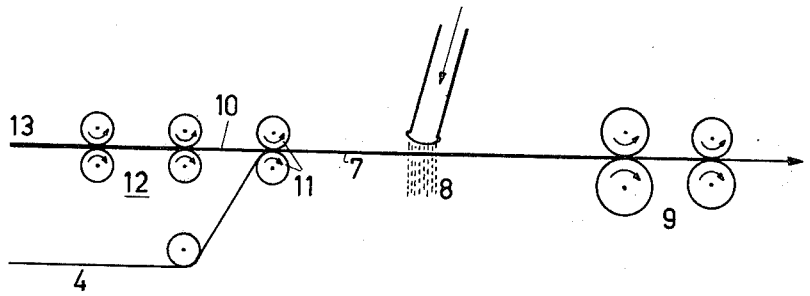

The invention will now be further explained in conjunction with the accompanying drawings, in which:

FIG. 1 shows schematically a part of an apparatus used for the manufacture of twistless yarn wherein a continuous filament yarn is added to a roving, and FIG. 2 shows schematically a part of such an apparatus wherein the continuous filament yarn is added to a drafted sliver at the final rollers used for the drafting of the sliver.

FIG. 1 illustrates how a roving 1 composed of staple fibres is drawn from a roving reel 2 and combined with continuous filament yarn 4 also drawn from a reel 3. The roving may be obtained through drafting and twisting a sliver drawn from an assembly of a staple fibres in the conventional way. The combination of roving 1 and continuous filament yarn 4 occurs during feed-through between rollers 5 and 6. A mixed fibre ribbon 7 thus obtained is brought into a wet condition by supplying a heated solvent 8, or passing it through this solvent, and fed to drafting rollers 9. The drafting method and the subsequent process phases for the manufacture of twistless or practically twistless yarn can further proceed as, for example, described in the co-pending U.S. applications Ser. Nos. 270,152 or 404,342. It should be noted that here, for instance, a card sliver instead of roving 1 can be added direct to rollers 5 and 6. Such a sliver is drawn from a funnel via two rollers, to which funnel a film, in which the staple fibres are situated randomly, is supplied and assembled.

FIG. 2 illustrates how a mixed fibre ribbon can be obtained through adding continuous filament yarn 4 to a drafted sliver 10 at the final rollers 11 of drafting rollers 12. These rollers are used for drafting of a sliver 13 drawn from an assembly of staple fibres. The mixed fibre sliver 7 produced by the rollers 11 is used in further processes required for the production of yarn. These processes are identical to those indicated in FIG. 1.

In the method illustrated in FIGS. 1 and 2 the process can be interrupted. For example, the card sliver or the roving can be coiled in a can or wound, respectively, and be withdrawn or unwound for subsequent processing. It is immaterial to the invention whether the process is interrupted or is carried out fully integrated.

It should be noted that the distance between the position at which the mixed fibre sliver is brought into a wet condition and the position at which the drafting is started should be such that the continuous filament yarn can assume a plastic state. This distance will therefore depend on the selection of the continuous filament yarn, the solvent, the temperature of this solvent and the thickness of the continuous filament yarn.

The method described above can be used with the various staple fibre materials referred to in the patent and patent applications incorporated herein by reference, such as natural fibres such as cotton, artificial fibres such as viscose rayon, or synthetic fibres such as polyamide, polyester or stabilized polyvinyl alcohol fibres. Solvent/potentially adhesive filament combinations can likewise be (eventually hot) water with unstabilized PVA or alginate materials; or water and suitable organic solvents (such as acetone, acetic acid, formic acid) with di- or tri-acetate materials.

What we claim is:

1. A method of manufacturing twistless yarn from a staple fibre material and a continuous filament yarn which is potentially adhesive upon application at least of moisture, including the sequential steps of:

combining the continuous filament yarn with the staple fibre material to obtain a mixed fibre ribbon, activating said continuous filament yarn to bring it at least into a plastic state, drafting the mixed fibre ribbon in a wet condition to form a thinner fibre ribbon, and bonding said thinner fibre ribbon.

2. A method according to claim 1, wherein the staple fibre material comprises a sliver drawn from an assembly of staple fibres and the combining step comprises combining the continuous filament yarn with the sliver during a feed-through between rollers.

3. A method according to claim 1, wherein the staple fibre material comprises a sliver drawn from an assembly of staple fibres, and comprising additionally the step of drafting said sliver, the continuous filament yarn being combined with the sliver at the final rollers of a drafting means used for drafting the sliver.

4. A method according to claim 1, wherein the staple fibre material comprises a roving obtained by drafting and twisting a sliver drawn from an assembly of staple fibres, the continuous filament yarn being combined with the roving during a feed-through between rollers.

5. A method as claimed in claim 1, wherein said activating step comprises applying solvent to said continuous filament yarn in a first zone, said solvent being of the same kind used for wet drafting of the ribbon, and moving said yarn from the first zone to a drafting zone such that the time of travel between said zones allows said continuous filament yarn to assume at least a plastic state.

6. A method as claimed in claim 5, wherein said step of applying solvent comprises supplying solvent to the ribbon after said yarn has been combined with the staple fibre material.

7. A yarn manufactured by the application of the method as claimed in claim 1.

* * * * *